US007312683B1

(12) United States Patent
Lee

(10) Patent No.: US 7,312,683 B1
(45) Date of Patent: Dec. 25, 2007

(54) SYMMETRICAL INDUCTOR

(75) Inventor: Sheng-Yuan Lee, Taipei (TW)

(73) Assignee: Via Technologies, Inc., Taipei (TW)

( * ) Notice: Subject to any disclaimer, the term of this patent is extended or adjusted under 35 U.S.C. 154(b) by 0 days.

(21) Appl. No.: 11/626,581

(22) Filed: Jan. 24, 2007

(30) Foreign Application Priority Data

Aug. 23, 2006 (TW) ..... 95130953 A

(51) Int. Cl.
*H01F 5/00* (2006.01)

(52) U.S. Cl. ..... 336/200

(58) Field of Classification Search ..... 336/65, 336/83, 200, 220–223, 232; 257/531
See application file for complete search history.

(56) References Cited

U.S. PATENT DOCUMENTS 3,181,096 A * 4/1965 Raub ..... 336/69
6,577,219 B2 * 6/2003 Visser ..... 336/200
6,794,977 B2 * 9/2004 Christensen ..... 336/200
6,870,457 B2 3/2005 Chen et al.
6,940,386 B2 * 9/2005 Mukherjee et al. ..... 336/200
6,967,555 B2 11/2005 Yu et al.
2005/0077992 A1 * 4/2005 Raghavan et al. ..... 336/200

* cited by examiner

*Primary Examiner*—Tuyen T. Nguyen
(74) *Attorney, Agent, or Firm*—Thomas, Kayden, Horstemeyer & Risley

(57) ABSTRACT

A symmetrical inductor. The inductor comprises first and second winding portions with a symmetrical arrangement and a coupling portion. Each winding portion comprises first, second, third and fourth semi-circular conductive lines arranged in concentricity and having first and second ends. The coupling portion comprises first and second pairs of connection layers, in which one pair are upper cross-connections and the other are lower cross-connections. The second ends of the first and fourth semi-circular conductive lines of the first winding portion are respectively connected to those of the second and third semi-circular conductive lines of the second winding portion by the first pair of connection layers. The second ends of the first and fourth semi-circular conductive lines of the second winding portion are respectively connected to those of the second and third semi-circular conductive lines of the first winding portion by the second pair of connection layers.

19 Claims, 4 Drawing Sheets

SYMMETRICAL INDUCTOR

BACKGROUND OF THE INVENTION

1. Field of the Invention

The invention relates to a semiconductor device and, in particular, to a symmetrical inductor in differential operation.

2. Description of the Related Art

Many digital and analog elements and circuits have been successfully applied to semiconductor integrated circuits. Such elements may include passive components, such as resistors, capacitors, or inductors. Typically, a semiconductor integrated circuit includes a silicon substrate. One or more dielectric layers are disposed on the substrate, with one or more metal layers disposed in the dielectric layers. The metal layers may be employed to form on-chip elements, such as on-chip inductors, by current semiconductor technologies.

Conventionally, the on-chip inductor is formed over a semiconductor substrate and employed in integrated circuits designed for radio frequency (RF) band. FIG. 1 is a plan view of a conventional two-turn symmetrical inductor. The inductor is formed in an insulating layer 110 on a substrate 100, comprising a first winding portion and a second winding portion symmetrical with respect to the dashed line 2 on the insulating layer 100. The first winding portion comprises a first semi-circular conductive line 101 and a second semi-circular conductive line 103 and the second winding portion comprises a third semi-circular conductive line 102 and a fourth semi-circular conductive line 104. The second semi-circular conductive line 103 is parallel to and located outside the first semi-circular conductive line 101. The fourth semi-circular conductive line 104 is parallel to and located outside the third semi-circular conductive line 102. Each semi-circular conductive line has a first end 10 and a second end 20, in which the first end 10 of the first semi-circular conductive line 101 extends to connect the first end 10 of the third semi-circular conductive line 102.

To maintain geometric symmetry, the second end 20 of the second semi-circular conductive line 103 is electrically connected to the second end 20 of the third semi-circular conductive line 102 through a lower cross-connection (underpass) 111. Moreover, the second end 20 of the fourth semi-circular conductive line 104 is electrically connected to the second end 20 of the first semi-circular conductive line 101 through an upper cross-connection 113. The first ends 10 of the second and fourth semi-circular conductive lines 103 and 104 have lateral extending portions 30 and 40 for inputting/outputting signals (not shown).

In order to improve the quality factor (i.e. Q value) of the inductor, techniques have been developed to increase the line width of each semi-circular conductive line, as shown in FIG. 2. Elements in FIG. 2 the same as those in FIG. 1 bear the same reference numbers and are not described again.

Currently, wireless communication chip designs frequently use differential circuits to reduce common mode noise, with inductors applied therein symmetrically. In the inductors shown in FIGS. 1 and 2, the lower cross-connection 111 is relatively closer to the substrate 100 with respect to the upper cross-connection 113. Thus, the parasitic capacitance between the substrate 100 and the primary coil constituted by the second semi-circular conductive lines 103, the third semi-circular conductive lines 102 and the lower cross-connection 111 exceeds that between the substrate 100 and the secondary coil constituted by the first semi-circular conductive lines 101, the fourth semi-circular conductive lines 104 and the upper cross-connection 111. Moreover, since the lower cross-connection 111 is thinner than the upper cross-connection 113, the conductor loss of the primary coil also exceeds that of the secondary coil. As a result, such an inductor cannot effectively reduce common mode noise in differential operation.

Thus, there exists a need in the art for an improved symmetrical inductor design to reduce common mode noise.

BRIEF SUMMARY OF INVENTION

A detailed description is given in the following embodiments with reference to the accompanying drawings.

A symmetrical inductor is provided. An embodiment of a symmetrical inductor comprises an insulating layer disposed on a substrate. First and second winding portions are symmetrically arranged in the insulating layer. Each winding portion comprises first, second, third and fourth semi-circular conductive lines arranged in concentricity and each semi-circular conductive line has a first end and a second end, wherein the first ends of the first and third semi-circular conductive lines of each winding portion are coupled to each other, the first ends of the second semi-circular conductive lines of the first and second winding portions are coupled to each other and the first ends of the fourth semi-circular conductive lines of the first and second winding portions are coupled to each other. A coupling portion is disposed in the insulating layer between the first and second winding portions, comprising a first pair of connection layers and a second pair of connection layers. One of the first pair of connection layers is connected to the second ends of the first semi-circular conductive line of the first winding portion and the second semi-circular conductive line of the second winding portion and the other is connected to the second ends of the fourth semi-circular conductive line of the first winding portion and the third semi-circular conductive line of the second winding portion. One of the second pair of connection layers is connected to the second ends of the first semi-circular conductive line of the second winding portion and the second semi-circular conductive line of the first winding portion and the other is connected to the second ends of the fourth semi-circular conductive line of the second winding portion and the third semi-circular conductive line of the first winding portion. One of the first and second pairs of the connection layers are upper cross-connections and the other are lower cross-connections.

Another embodiment of a symmetrical inductor comprises an insulating layer disposed on a substrate. At least two first conductive line sets are disposed in the insulating layer, wherein each first conductive line set comprises two first conductive lines. At least two second conductive line sets are disposed in the insulating layer, wherein each second conductive line set comprises two second conductive lines. A central region is surrounded by the first and second conductive line sets. At least first and second cross-connection sets are connected to the first conductive line set and the corresponding second conductive line set, wherein each cross-connection set comprises a first cross-connection and a second cross-connection. For the odd-numbered sets of the first and second conductive line sets from the central region to outside, the inner first conductive line is electrically connected to the outer second conductive line by the first cross-connection of the first cross-connection set and the outer first conductive line is electrically connected to the inner second conductive line by the second cross-connection of the first cross-connection set. For the even-numbered sets of the first and second conductive line sets from the central region to outside, the inner first conductive line is electrically connected to the outer second conductive line by the second cross-connection of the second cross-connection set and the outer first conductive line is electrically connected to the inner second conductive line by the first cross-connection of the second cross-connection set.

Yet another embodiment of a symmetrical inductor comprises an insulating layer disposed on a substrate. At least one first conductive line set is disposed in the insulating layer comprising four first conductive lines. At least one second conductive line set is disposed in the insulating layer comprising four second conductive lines. At least one cross-connection set is connected to the first conductive line set and the corresponding second conductive line set, wherein the cross-connection set comprises two first cross-connections and two second cross-connections. Two outer first conductive lines of the first conductive line set are electrically connected to two inner second conductive lines of the second conductive line set by the first cross-connections and two inner first conductive lines of the first conductive line set are electrically connected to two outer second conductive lines of the second conductive line set by the second cross-connections.

BRIEF DESCRIPTION OF DRAWINGS

The invention can be more fully understood by reading the subsequent detailed description and examples with references made to the accompanying drawings, wherein.

DETAILED DESCRIPTION OF INVENTION

The following description is of the best-contemplated modes of carrying out the invention. This description is provided for the purpose of illustrating the general principles of the invention and should not be taken in a limiting sense. The scope of the invention is best determined by reference to the appended claims. The symmetrical inductor of the invention will be described in the following with reference to the accompanying drawings.

Figure 1:
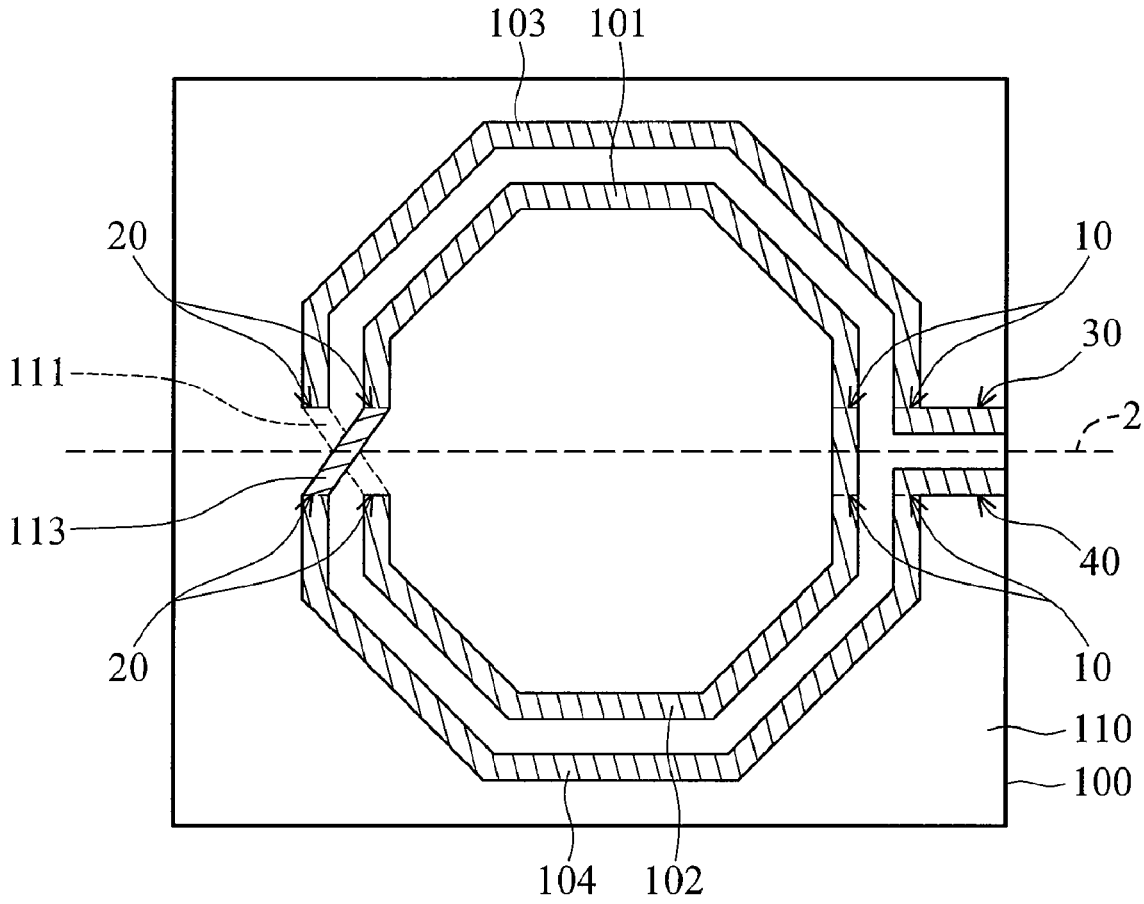
FIG. 1 ( RELATED ART )
FIG. 1 is a plan view of a conventional two-turn symmetrical inductor.
Figure 2:
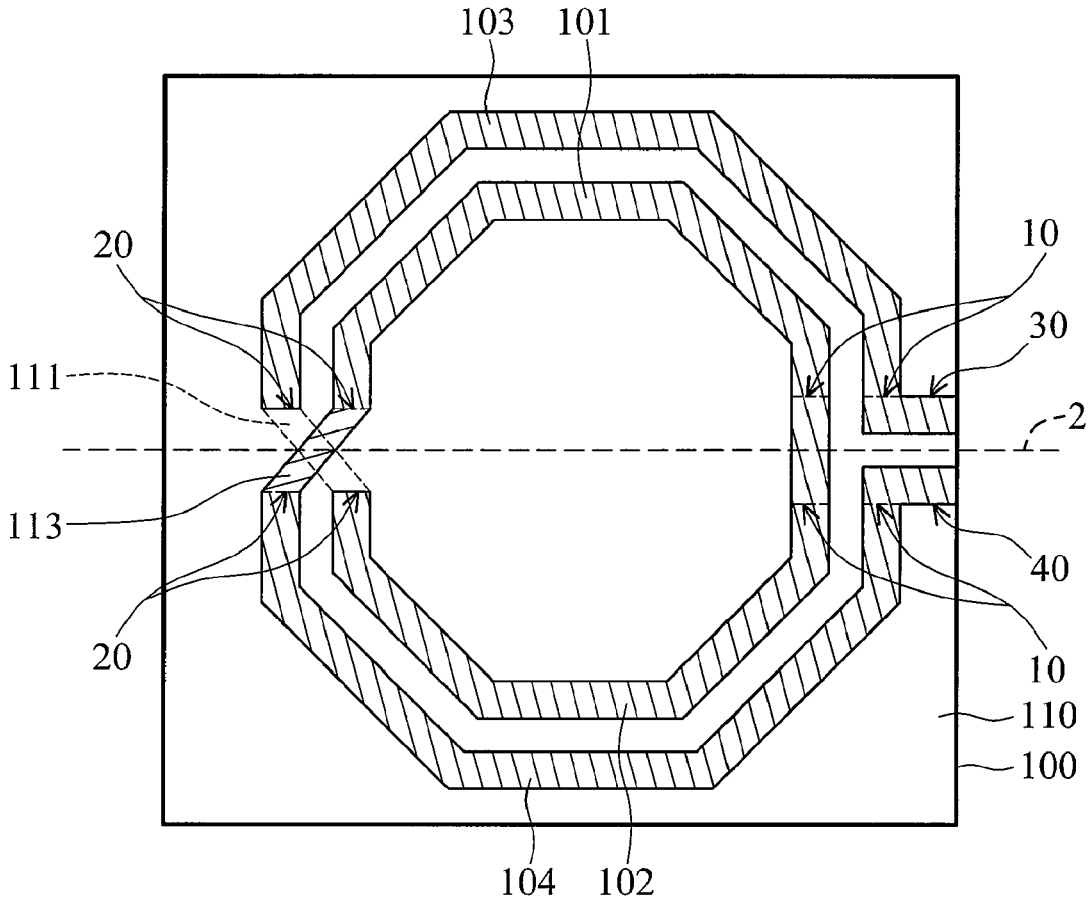
FIG. 2 ( RELATED ART )
FIG. 2 is a plan view of a conventional two-turn symmetrical inductor.
Figure 3:
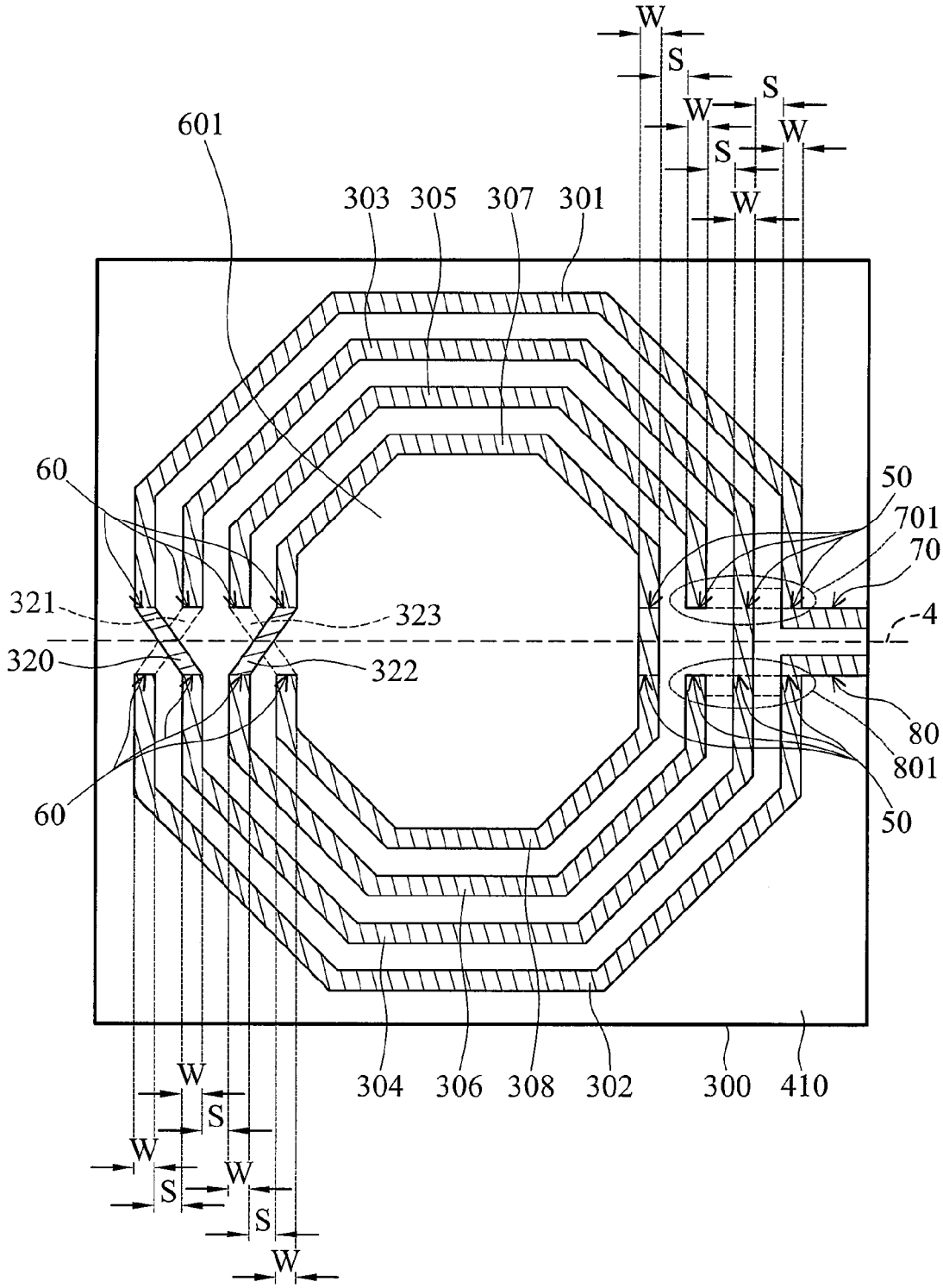
FIG. 3 is a plan view of an embodiment of a two-turn symmetrical inductor.

FIG. 3 is a plan view of an embodiment of a two-turn symmetrical inductor. The symmetrical inductor comprises an insulating layer 410, first and second winding portions, and a coupling portion. The insulating layer 410 is disposed on a substrate 300.

The substrate 300 may include a silicon substrate or other known semiconductor substrates. The substrate 300 may include various devices, such as transistors, resistors, or other well-known semiconductor devices. Moreover, the substrate 300 may also include other conductive layers (e.g. copper, aluminum, tungsten or alloy thereof) and insulating layers (e.g. silicon oxide, silicon nitride, or low-k dielectric material). Hereinafter, to simplify the diagram, only a flat substrate is depicted.

Additionally, the insulating layer 410 may be a single low-k dielectric layer or multi-layer dielectrics. In this embodiment, the insulating layer 410 may include silicon oxide, silicon nitride, or low-k dielectric material.

The first winding portion is disposed in the insulating layer 410 and located at a first side of dashed line 4. The first winding portion may comprise a first semi-circular conductive line 301, a second semi-circular conductive line 303, a third semi-circular conductive line 305, and a fourth semi-circular conductive line 307 arranged in concentricity. The second winding portion is disposed in the insulating layer 410 and located at a second side opposite to the first side of dashed line 4. The second winding portion may comprise a first semi-circular conductive line 302, a second semi-circular conductive line 304, a third semi-circular conductive line 306, and a fourth semi-circular conductive line 308 arranged in concentricity. The second winding portion and the first winding portion are symmetrical with respect to the dashed line 4. The first and second winding portions may be circular, rectangular, hexagonal, octagonal, or polygonal. To simplify the diagram, only an exemplary octagonal shape is depicted. Moreover, the first and second winding portions may comprise copper, aluminum, or alloy thereof.

In some embodiments, the first, second, third and fourth semi-circular conductive lines 301, 303, 305 and 304 of the first winding portion and the first, second, third and fourth semi-circular conductive lines 302, 304, 306 and 308 of the second winding portion have the same line width W and the same line space S.

Moreover, each semi-circular conductive line has a first end 50 and a second end 60. In this embodiment, the first ends 50 of the first and third semi-circular conductive lines 301 and 305 of the first winding portion are coupled, and the first ends 50 of the first and third semi-circular conductive lines 302 and 306 of the second winding portion are coupled. For example, the first and third semi-circular conductive lines 301 and 305 of the first winding portion may be coupled through a lower connect 701, and the first and third semi-circular conductive lines 302 and 306 of the second winding portion may be coupled through another lower connect 801.

The first semi-circular conductive lines 301 and 302 of the first and second winding portions have lateral extending portions 70 and 80 for inputting/outputting signals. Moreover, the first end 50 of the second semi-circular conductive line 303 of the first winding portion extends to and is coupled to the first end 50 of the second semi-circular conductive line 304 of the second winding portion. The first end 50 of the fourth semi-circular conductive line 307 of the first winding portion extends to and is coupled to the first end 50 of the fourth semi-circular conductive line 308 of the second winding portion.

The coupled portion is disposed in the insulating layer 410 between the first and second winding portions. The coupling portion comprises a first pair of connection layers 320 and 322 and a second pair of connection layers 321 and 323 to connect the second ends 60 of the first and second winding portions.

In this embodiment, to maintain geometric symmetry, the first pair of connection layers 320 and 322 connects the second end 60 of the first semi-circular conductive line 301 of the first winding portion and the second end 60 of the second semi-circular conductive line 304 of the second winding portion, and the first pair of connection layers 320 and 322 also connects the second end 60 of the fourth semi-circular conductive line 307 of the first winding portion and the second end 60 of the third semi-circular conductive line 306 of the second winding portion. Moreover, the second pair of connection layers 321 and 323 connects the second end 60 of the first semi-circular conductive line 302 of the second winding portion and the second end 60 of the second semi-circular conductive line 303 of the first winding portion, and the second pair of connection layers 321 and 323 also connects the second end 60 of the fourth semi-circular conductive line 308 of the second winding portion and the second end 60 of the third semi-circular conductive line 305 of the first winding portion.

In the first pair of connection layers 320 and 322 and the second pair of connection layers 321 and 323, one pair is upper cross-connections, and the other pair is lower cross-connections. In this embodiment, the first pair of connection layers 320 and 322 is upper cross-connections, and the second pair of connection layers 321 and 323 is lower cross-connections. In some embodiments, the first pair of connection layers 320 and 322 may be lower cross-connections, and the second pair of connection layers 321 and 323 may be upper cross-connections.

As shown in FIG. 3, a primary coil is constituted by the first and third semi-circular conductive lines 301 and 305 of the first winding portion and the second and fourth semi-circular conductive lines 304 and 308 of the second winding portion. The primary coil may comprise an upper cross-connection and a lower cross-connection serving as an electrical connection layer. Moreover, a secondary coil is constituted by the first and third semi-circular conductive lines 302 and 306 of the second winding portion and the second and fourth semi-circular conductive lines 303 and 307 of the first winding portion. The secondary coil may also comprise an upper cross-connection and a lower cross-connection serving as an electrical connection layer. That is, the number of upper and lower cross-connections in the primary coil is the same as that in the secondary coil.

Accordingly, a parasitic capacitance between the primary coil and the substrate 300 can be substantially equal to that between the secondary coil and the substrate 300. The conductor loss of the primary coil can be substantially equal to that of the secondary coil. According to the invention, since the primary coil and the secondary coil of the symmetrical inductor substantially have the same parasitic capacitance and conductor loss in differential operation, the common mode noise can be effectively reduced.

Figure 4:
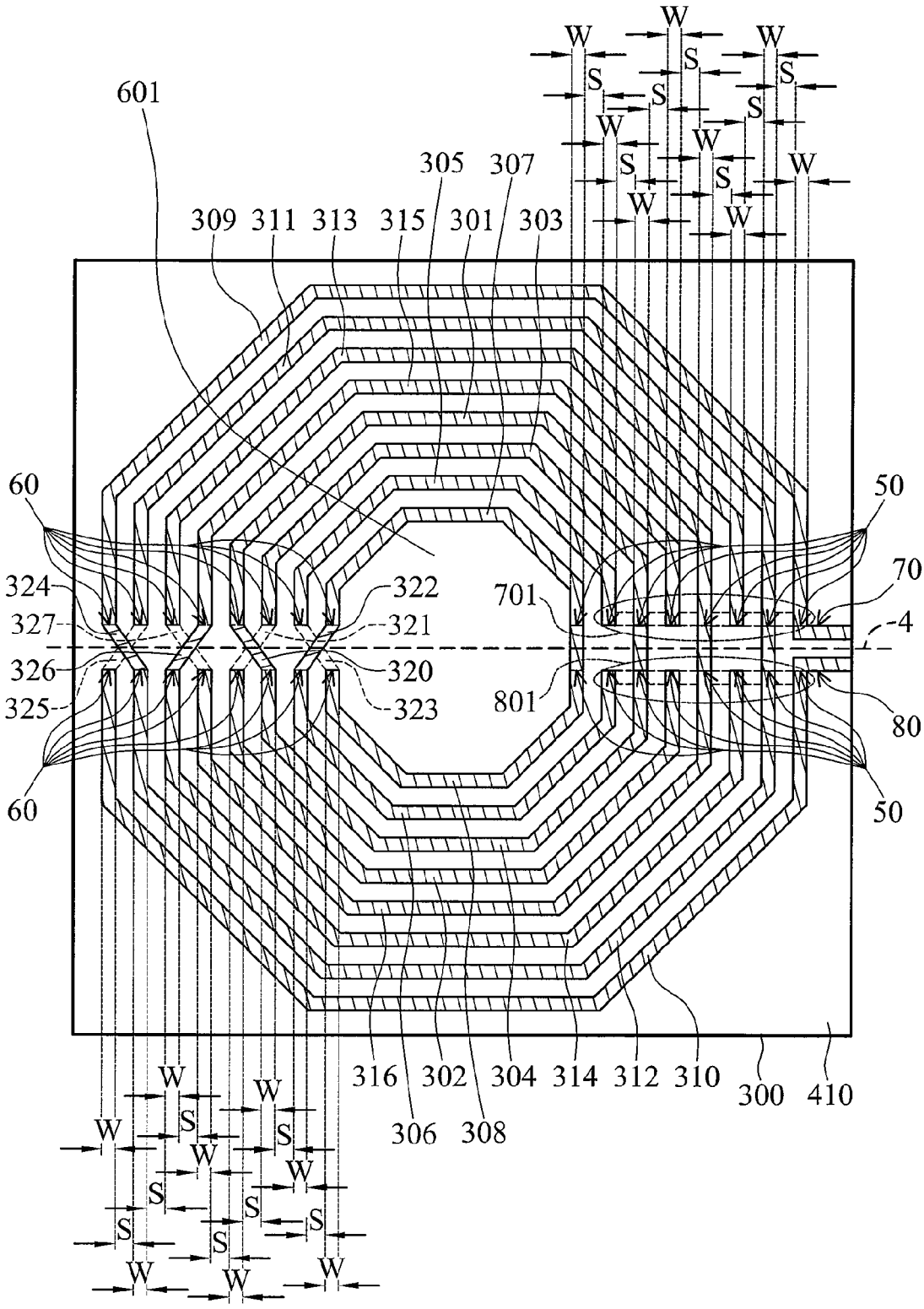
FIG. 4 is a plan view of an embodiment of a two-turn symmetrical inductor.

FIG. 4 is a plan view of an embodiment of a two-turn symmetrical inductor. If the elements in FIG. 4 are the same as those in FIG. 3, the elements will be labeled as the same reference numbers as in FIG. 3 and will not be described again. In this embodiment, the symmetrical inductor further comprises a third winding portion, a fourth winding portion and a second coupling portion. The third winding portion is disposed in the dielectric layer 410 outside the first winding portion. The third winding portion may comprise a first semi-circular conductive line 309, a second semi-circular conductive line 311, a third semi-circular conductive line 313, and a fourth semi-circular conductive line 315 arranged in concentricity. The fourth winding portion may comprise a first semi-circular conductive line 310, a second semi-circular conductive line 312, a third semi-circular conductive line 314, and a fourth semi-circular conductive line 316 arranged in concentricity. The third and fourth winding portions may be circular, rectangular, hexagonal, octagonal, or polygonal. Moreover, the third and fourth winding portions may comprise copper, aluminum, or alloy thereof.

In this embodiment, the first, second, third and fourth semi-circular conductive lines 309, 311, 313 and 315 of the third winding portion and the first, second, third and fourth semi-circular conductive lines 310, 312, 314 and 316 of the fourth winding portion have the same line width W and the same line space S.

In this embodiment, the first ends 50 of the first and third semi-circular conductive lines 309 and 313 are coupled to each other and also coupled to first semi-circular conductive line 301 of the first winding portion. The first ends 50 of the first and third semi-circular conductive lines 310 and 314 are coupled to each other and also coupled to first semi-circular conductive line 302 of the second winding portion. For example, the first and third semi-circular conductive lines 309 and 313 of the third winding portion are coupled through a lower connect 701, and the first and third semi-circular conductive lines 310 and 314 of the fourth winding portion are coupled through another lower connect 801.

The first semi-circular conductive lines 309 and 310 of the third and fourth winding portions have lateral extending portions 70 and 80 for inputting/outputting signals. Moreover, the first end 50 of the second semi-circular conductive line 311 of the third winding portion extends to and is coupled to the first end 50 of the second semi-circular conductive line 312 of the fourth winding portion. The first end 50 of the fourth semi-circular conductive line 315 of the third winding portion extends to and is coupled to the first end 50 of the fourth semi-circular conductive line 316 of the fourth winding portion.

The second coupled portion is disposed in the insulating layer 410 between the third and fourth winding portions. The second coupling portion comprises a third pair of connection layers 324 and 326 and a fourth pair of connection layers 325 and 327 to connect the second ends 60 of the third and fourth winding portions. The third pair of connection layers 324 and 326 connects the second end 60 of the first semi-circular conductive line 309 of the third winding portion and the second end 60 of the second semi-circular conductive line 312 of the fourth winding portion, and the third pair of connection layers 324 and 326 also connects the second end 60 of the fourth semi-circular conductive line 315 of the third winding portion and the second end 60 of the third semi-circular conductive line 314 of the fourth winding portion. Moreover, the fourth pair of connection layers 325 and 327 connects the second end 60 of the first semi-circular conductive line 310 of the fourth winding portion and the second end 60 of the second semi-circular conductive line 311 of the third winding portion, and the fourth pair of connection layers 325 and 327 connects the second end 60 of the fourth semi-circular conductive line 316 of the fourth winding portion and the second end 60 of the third semi-circular conductive line 313 of the second winding portion.

In the third pair of connection layers 324 and 326 and the fourth pair of connection layers 325 and 327, one pair is upper cross-connections and the other pair is lower cross-connections. In this embodiment, the third pair of connection layers 324 and 326 is upper cross-connections and the fourth pair of connection layers 325 and 327 is lower cross-connections, as shown in FIG. 4. In some embodiments, the third pair of connection layers 324 and 326 may be lower cross-connections and the fourth pair of connection layers 325 and 327 may be upper cross-connections.

As shown in FIG. 4, a primary coil is constituted by the first and third semi-circular conductive lines 301 and 305 of the first winding portion, the first and third semi-circular conductive lines 309 and 313 of the third winding portion, the second and fourth semi-circular conductive lines 304 and 308 of the second winding portion, and the second and fourth semi-circular conductive lines 312 and 316 of the fourth winding portion. A secondary coil is constituted by the first and third semi-circular conductive lines 302 and 306 of the second winding portion, the first and third semi-circular conductive lines 310 and 314 of the fourth winding portion, the second and fourth semi-circular conductive lines 303 and 307 of the first winding portion, and the second and fourth semi-circular conductive lines 311 and 315 of the third winding portion. The number of upper and lower cross-connections in the primary coil is the same as that in the secondary coil. Accordingly, the common mode noise can be effectively reduced in differential operation.

In this embodiment, two ends of the lower cross-connection are respectively electrically connected to one end of a via hole having a conductive material therein, such as copper, aluminum, or alloy thereof. The other end of the via hole is electrically connected to the second end of the conductive line. Moreover, the lower connection layer 701 or 801 is electrically connected to one end of a via hole having a conductive material therein, such as copper, aluminum, or alloy thereof. The other end of the via hole is electrically connected to the first end of the conductive line.

In FIGS. 3 and 4, a region surrounded by the conductive lines 307 and 308 is referred to as a central region 601. The conductive lines 307, 303, 308, 304, 315, 311, 316 and 312 are odd-numbered from the central region 601 to outside, and the conductive lines 305, 301, 306, 302, 313, 309, 314 and 310 are even-numbered. Each conductive line has a first end 50 and a second end 60. The first ends 50 of two outermost conductive lines with respect to the central region 601 (i.e. the conductive lines 301 and 302 shown in FIG. 3 or the conductive lines 309 and 310 shown in FIG. 4) are connected to lateral extending portions 70 and 80, respectively.

The first ends 50 of the conductive lines may be connected by either electrically connecting the first ends 50 of the even-numbered conductive lines on the same side of dashed line 4 or, alternatively, by electrically connecting the first end 50 of each odd-numbered conductive line on one side of dashed line 4 to that of the corresponding odd-numbered conductive line on the other side of dashed line 4.

With respect to the first connecting method, for example, the conductive lines 301 and 305 on one side of dashed line 4 can be even-numbered, electrically connected to each other through a lower connection layer 701. Moreover, the conductive lines 302 and 306 on the other side of dashed line 4 are also even-numbered, electrically connected to each other through a lower connection layer 801, as shown in FIG. 3. In FIG. 4, the conductive lines 301, 305, 313 and 309 on one side of dashed line 4 are even-numbered, electrically connected to each other through a lower connection layer 701. Moreover, the conductive lines 302, 306, 314 and 310 on the other side of dashed line 4 are also even-numbered, electrically connected to each other through a lower connection layer 801. Note that the lower connection layer 701 or 801 shown in FIG. 4 may comprise a single connection layer to connect all of the even-numbered conductive lines on the same side of dashed line 4, or a plurality of connection layers, in which each connection layer is electrically connected between adjacent even-numbered conductive lines on the same side of dashed line 4.

With respect to the second connecting method, the conductive lines 307, 303, 315 and 311 on one side of dashed line 4 are odd-numbered, electrically connecting the corresponding conductive lines, 308, 304, 316 and 312 on the other side of dashed line 4, as shown in FIGS. 3 and 4.

With respect to the connection for the second ends 60 of the conductive lines, the adjacent conductive lines, such as the conductive lines 307 and 305, the conductive lines 308 and 306, the conductive lines 303 and 301 and the conductive lines 304 and 302, are referred to as conductive line sets. The second end 60 of the inner conductive line of each conductive set is electrically connected to that of the outer conductive line of the corresponding conductive line set through a cross-connection. That is, the corresponding conductive line sets on both sides of dashed line 4 require two cross-connections for electrical connection therebetween. Moreover, each of the two cross-connections crosses the other. For example, if there are a first set of first conductive line set (i.e. conductive lines 307 and 305) and a second set of first conductive line set (i.e. conductive lines 303 and 301) on one side of dashed line 4 and a first set of second conductive line set (i.e. conductive lines 308 and 306) and a second set of second conductive line set (i.e. conductive lines 304 and 302) on the other side of dashed line 4, as shown in FIGS. 3 and 4, there are two cross-connections 322 and 323 between the first set of first conductive line set and the first set of second conductive line set and two cross-connections 320 and 321 between the second set of first conductive line set and the second set of second conductive line set.

In FIGS. 3 and 4, the odd-numbered set(s) of the first and corresponding second conductive line sets form the central region 601 to outside may have the same cross-connection structure(s) therebetween, which is different from that between the even-numbered set(s) of the first and corresponding second conductive line sets. For example, while the cross-connection connecting the inner conductive line 307 of the first set of first conductive line set and the outer conductive line 306 of the first set of second conductive line set is disposed at the same level with the conductive lines 306 and 307, the cross-connection connecting the inner conductive line 303 of the second set of first conductive line set and the outer conductive line 302 of the second set of second conductive line set is disposed below the conductive lines 302 and 303. Moreover, the cross-connection connecting the outer conductive line 305 of the first set of first conductive line set and the inner conductive line 308 of the first set of second conductive line set is disposed below the conductive lines 305 and 308, and the cross-connection connecting between the outer conductive line 301 of the second set of first conductive line set and the inner conductive line 304 of the second set of second conductive line set is disposed at the same level with the conductive lines 301 and 304.

With respect to the connection for the second ends 60 of the conductive lines, the adjacent four conductive lines, such as conductive lines 307, 305, 303 and 301 or conductive lines 308, 306, 304 and 302, may be referred to as a conductive line set In FIGS. 3 and 4, for example, a first conductive line set is constituted by conductive lines 307, 305, 303 and 301, and a second conductive line set is constituted by conductive lines 308, 306, 304 and 302. The second ends 60 of the outer conductive lines 301 and 307 of the first conductive line set are electrically connected to those of the inner conductive lines 304 and 306 of the second conductive line set through a first cross-connection set (i.e. cross-connections 320 and 322). Moreover, the second ends 60 of the inner conductive lines 303 and 305 of the first conductive line set are electrically connected to those of the outer conductive lines 302 and 308 of the second conductive line set through a second cross-connection set (i.e. cross-connections 321 and 323).

Moreover, the first and second cross-connection sets are crossed. One of the first and second cross-connection sets are disposed at the same level with the conductive lines, and the other is disposed below the conductive line, and cross-connections 322 and 323 near the central portion 601 are crossed and the cross-connections 320 and 321 away from the central portion 601 are also crossed.

Note that the method for connection of the second ends of the conductive lines is not employed to connect the first ends of the conductive lines to avoid destruction of inductor symmetry by the parasitic capacitance induced by the substrate.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A symmetrical inductor, comprising:

an insulating layer disposed on a substrate;

first and second winding portions symmetrically arranged in the insulating layer, wherein each winding portion comprises first, second, third and fourth semi-circular conductive lines, and each semi-circular conductive line has a first end and a second end, wherein the first ends of the first and third semi-circular conductive lines of each winding portion are coupled to each other, the first ends of the second semi-circular conductive lines of the first and second winding portions are coupled to each other and the first ends of the fourth semi-circular conductive lines of the first and second winding portions are coupled to each other; and a first coupling portion disposed in the insulating layer between the first and second winding portions, comprising:

a first pair of connection layers, wherein one of the first pair of connection layers is connected to the second ends of the first semi-circular conductive line of the first winding portion and the second semi-circular conductive line of the second winding portion, and the other one of the first pair of connection layers is connected to the second ends of the fourth semi-circular conductive line of the first winding portion and the third semi-circular conductive line of the second winding portion; and a second pair of connection layers, wherein one of the second pair of connection layers is connected to the second ends of the first semi-circular conductive line of the second winding portion and the second semi-circular conductive line of the first winding portion, and the other one of the second pair of connection layers is connected to the second ends of the fourth semi-circular conductive line of the second winding portion and the third semi-circular conductive line of the first winding portion;

wherein one of the first and second pairs of the connection layers is upper cross-connections and the other pair is lower cross-connections.

2. The symmetrical inductor as claimed in claim 1, wherein the first, second, third and fourth semi-circular conductive lines of the first and second winding portions have the same line width and the same line space.

3. The symmetrical inductor as claimed in claim 1, wherein the first and second winding portions are circular, rectangular, hexagonal, octagonal, or polygonal.

4. The symmetrical inductor as claimed in claim 1, further comprising:

third and fourth winding portions respectively disposed outside and parallel to the first and second winding portions, wherein each winding portion comprises first, second, third and fourth semi-circular conductive lines arranged and each semi-circular conductive line has a first end and a second end, wherein the first ends of the first and third semi-circular conductive lines of each winding portion are coupled to each other, the first ends of the second semi-circular conductive lines of the third and fourth winding portions are coupled to each other and the first ends of the fourth semi-circular conductive lines of the third and fourth winding portions are coupled to each other; and a second coupling portion disposed in the insulating layer between the third and fourth winding portions, comprising:

a third pair of connection layers connected to the second ends of the first semi-circular conductive line of the third winding portion and the second semi-circular conductive line of the fourth winding portion and also connected to the second ends of the fourth semi-circular conductive line of the third winding portion and the third semi-circular conductive line of the fourth winding portion; and a fourth pair of connection layers connected to the second ends of the first semi-circular conductive line of the fourth winding portion and the second semi-circular conductive line of the third winding portion and also connected to the second ends of the fourth semi-circular conductive line of the fourth winding portion and the third semi-circular conductive line of the third winding portion;

wherein one of the third and fourth pairs of the connection layers is an upper cross-connection and the other is a lower cross-connection.

5. The symmetrical inductor as claimed in claim 4, wherein the first, second, third and fourth semi-circular conductive lines of the third and fourth winding portions have the same line width and the same line space.

6. The symmetrical inductor as claimed in claim 4, wherein the third and fourth winding portions are circular, rectangular, hexagonal, octagonal, or polygonal.

7. A symmetrical inductor, comprising:

an insulating layer disposed on a substrate;

at least two first conductive line sets disposed in the insulating layer, wherein each first conductive line set comprises two first conductive lines;

at least two second conductive line sets disposed in the insulating layer, wherein each second conductive line set comprises two second conductive lines;

a central region surrounded by the first and second conductive line sets; and at least first and second cross-connection sets connected to the first conductive line set and its corresponding second conductive line set, wherein each cross-connection set comprises a first cross-connection and a second cross-connection;

wherein, among the first and second conductive line sets from the central region to outside, for the odd-numbered sets, the inner first conductive line is electrically connected to the outer second conductive line by the first cross-connection of the first cross-connection set, and the outer first conductive line is electrically connected to the inner second conductive line by the second cross-connection of the first cross-connection set;

wherein, among the first and second conductive line sets from the central region to outside, for the even-numbered sets, the inner first conductive line is electrically connected to the outer second conductive line by the second cross-connection of the second cross-connection set, and the outer first conductive line is electrically connected to the inner second conductive line by the first cross-connection of the second cross-connection set.

8. The symmetrical inductor as claimed in claim 7, wherein the first cross-connection crosses the second cross-connection.

9. The symmetrical inductor as claimed in claim 7, wherein the outer first conductive lines of the adjacent first conductive line sets are electrically connected to each other.

10. The symmetrical inductor as claimed in claim 7, wherein the outer second conductive lines of the adjacent first conductive line sets are electrically connected to each other.

11. The symmetrical inductor as claimed in claim 7, wherein the inner first conductive line of one of the first conductive line sets is electrically connected to the inner second conductive line of the corresponding second conductive line set.

12. The symmetrical inductor as claimed in claim 7, wherein the first and second conductive lines have the same line width and the same line space.

13. The symmetrical inductor as claimed in claim 7, wherein the first and second conductive lines are circular, rectangular, hexagonal, octagonal, or polygonal.

14. A symmetrical inductor, comprising:

an insulating layer disposed on a substrate;

at least one first conductive line set disposed in the insulating layer, comprising four first conductive lines;

at least one second conductive line set disposed in the insulating layer, comprising four second conductive lines; and at least one cross-connection set connected to the first conductive line set and also connected to the second conductive line set corresponding to the first conductive line set, wherein the cross-connection set comprises two first cross-connections and two second cross-connections;

wherein two outer first conductive lines of the first conductive line set are electrically connected to two inner second conductive lines of the second conductive line set by the first cross-connections, and two inner first conductive lines of the first conductive line set are electrically connected to two outer second conductive lines of the second conductive line set by the second cross-connections.

15. The symmetrical inductor as claimed in claim 14, wherein the first cross-connections cross the second cross-connections.

16. The symmetrical inductor as claimed in claim 14, wherein the even-numbered first or second conductive lines from inside to outside are connected to each other.

17. The symmetrical inductor as claimed in claim 14, wherein, from inside to outside, one of the even-numbered lines of the conductive lines in one conductive line set, is connected to one of the even-numbered lines of the conductive lines in another one conductive line set.

18. The symmetrical inductor as claimed in claim 14, wherein, from inside to outside, one of the odd-numbered first conductive lines in one first conductive line set is connected to the corresponding odd-numbered second conductive line in the corresponding second conductive line set.

19. The symmetrical inductor as claimed in claim 14, wherein the first and second conductive lines are circular, rectangular, hexagonal, octagonal, or polygonal.

* * * * *